US005868053A

United States Patent [19]

Foltz

[11] Patent Number: 5,868,053

[45] Date of Patent: Feb. 9, 1999

[54] CARPET CUTTING APPARATUS AND METHOD

[76] Inventor: Mark S. Foltz, 1650 Lake Grove Rd., Petoskey, Mich. 49770

[21] Appl. No.: 676,059

[22] Filed: Jul. 5, 1996

[51] Int. Cl.[6] ..... B26D 1/04

[52] U.S. Cl. ..... 83/13; 83/23; 83/175; 30/169

[58] Field of Search ..... 83/13, 18, 175, 83/176, 23, 27; 30/169, 170; 299/39.4; 156/344, 584

[56] References Cited

U.S. PATENT DOCUMENTS

| | | | |
|---|---|---|---|
| 695,495 | 3/1902 | Russel . | |
| 980,404 | 1/1911 | Boff . | |
| 4,837,933 | 6/1989 | Chapman | 30/170 |
| 4,948,451 | 8/1990 | Foltz . | |
| 4,963,224 | 10/1990 | Anderson | 30/170 |
| 4,983,809 | 1/1991 | Maiette | 30/170 |
| 5,002,629 | 3/1991 | Nakamura | 30/170 |
| 5,037,160 | 8/1991 | Ukai | 30/170 |
| 5,218,766 | 6/1993 | Himebaugh | 30/170 |
| 5,415,725 | 5/1995 | Scharf . | |

*Primary Examiner*—Maurina T. Rachuba
*Attorney, Agent, or Firm*—Fildes & Outland, P.C.

[57] ABSTRACT

Apparatus for cutting carpet mounted on a supporting surface into elongated strips includes a frame having forward and rearward ends, a handle extending from the frame for guiding and maneuvering the apparatus, a horizontally disposed drive roller, rotatable about a drive roller axis mounted between the forward and rearward frame ends for propelling the apparatus in a forward direction as the drive roller is rotated engaging a plurality of generally radially extending carpet engagement members for non-slippingly engaging the carpet between the drive roller and supporting surface, and a pair of knives spacedly mounted about the forward end of the apparatus for cutting the carpet into an elongated strip as the carpet stripping apparatus is propelled forward.

16 Claims, 2 Drawing Sheets

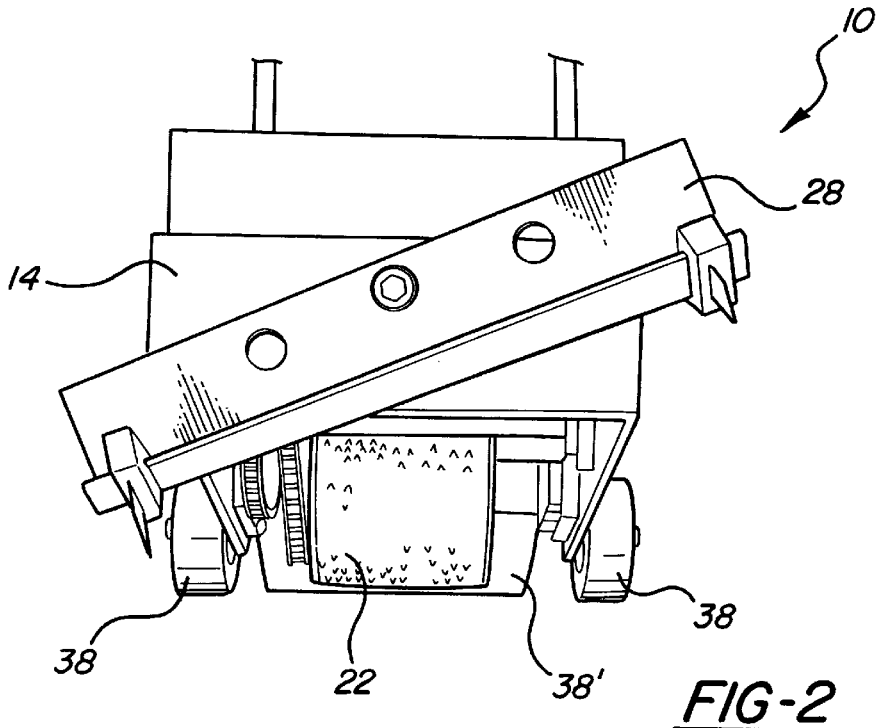
FIG-2
FIG-3
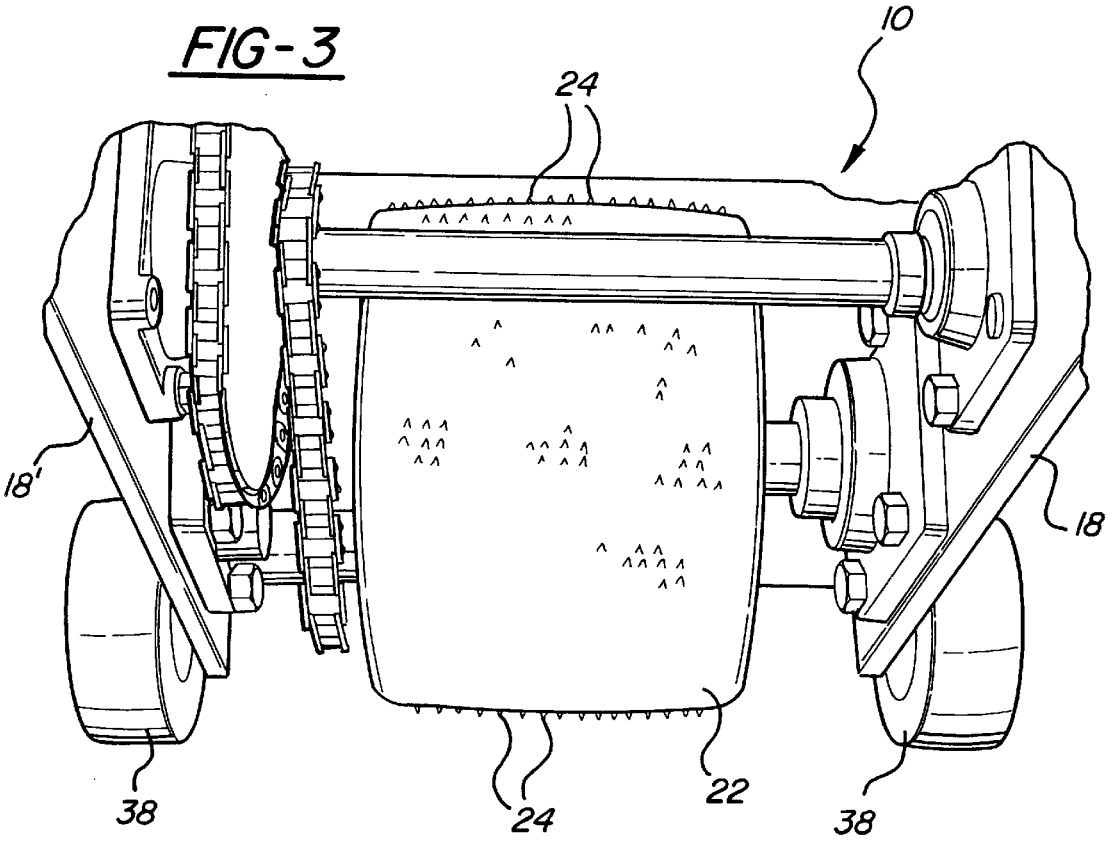

CARPET CUTTING APPARATUS AND METHOD

FIELD OF THE INVENTION

This invention relates to a carpet cutting apparatus and method and more particularly to an improved apparatus for cutting a carpet into an elongated strip to facilitate subsequent stripping of the carpet from its supporting surface.

BACKGROUND OF THE INVENTION

It is current practice to strip carpet glued to a concrete surface or other supporting surface manually or automatically. The manual method requires workmen physically separating small sections of carpet using various hand tools, is time consuming and therefore expensive.

Automatic methods utilize carpet stripping machines in which a section of carpet is fed between a plurality of rollers mounted on the machines. As one or more of the rollers are driven, the carpet is drawn between the rollers propelling the machine forward. The forward motion of these machines may be used to cut the carpet into an elongated strip as knives mounted on the front of the machine are slid through the carpet. These automatic carpet stripping machines are also designed to lift the carpet off the supporting surface as the carpet is passed over one of the rollers.

These automatic machines require a substantial amount of horsepower to perform the operations of cutting and stripping in this fashion. Occasionally the motor used to supply the driving force for the rollers is stalled due to the power required to cut and lift the carpet in a cutting and stripping operation. Therefore, large motors are used in these machines making them expensive and also heavy for an operator or workman to handle during movement of a machine from job to job.

In addition, these machines have also had their forward motion stalled by the slipping of the carpet between the rollers.

SUMMARY OF THE INVENTION

The present invention provides a carpet cutting apparatus and method for cutting carpet glued onto cement or other supporting surface into an elongated strip. The carpet can then be more efficiently lifted by conventional carpet stripping apparatus in a subsequent operation.

The carpet cutting apparatus comprises a frame having forward and rearward ends. A handle extends from the frame for guiding and maneuvering the apparatus over the carpet to be cut. A horizontally disposed drive roller mounted between the forward and rearward frame ends is rotatable about a drive roller axis for propelling the carpet cutting apparatus over the carpet to be cut.

The drive roller includes a plurality of generally radially extending carpet engagement members for non-slippingly engaging the carpet between the drive roller and supporting surface. A pair of knives spacedly mounted about the forward end of the carpet cutting apparatus cut the carpet into an elongated strip as the carpet stripping apparatus is propelled forward.

In one embodiment of the invention, the carpet cutting apparatus includes an idler support wheel mounted about the rearward frame end for supporting the frame above the carpet. The idler support wheel may be a plurality of individual support wheels or may be an elongated roller. Preferably, the handle for guiding and maneuvering the carpet cutting apparatus is mounted to a frame aft of the drive roller whereby upper force applied to the handle by an operator or workman exerts a downward force on the drive roller.

The carpet cutting apparatus includes a drive motor and transmission for driving the drive roller. Preferably the drive motor is mounted on the frame between the drive roller and the idler support wheel.

In a preferred embodiment, a knife bar is pivotly mounted on the forward end of the carpet cutting apparatus. The knife bar includes spaced knives adjustable relative to each other for changing the width of the cut of the carpet. A spacer sleeve mounted in an aperture in the knife bar and extending beyond the thickness of the knife bar accepts a bolt extending through a vertically extending slot in the forward end of the frame. This arrangement allows height adjustment of the knife bar relative to the frame thereby providing adjustment of the effective length of the carpet engagement members.

The carpet engagement members are defined by projections extending in the range of 1/16 to 1/2 inch from the surface of the drive roller. Preferably, the carpeting engagement members are generally less than 3/8 of an inch in diameter and include a distal end of an arcuate shape for engaging the base of the pile of a carpet to be cut. Preferably, these carpet engaging projections are formed integrally with the drive roller surface.

The method of cutting the carpet mounted or adhered to a supporting surface into an elongated strip comprises the steps of engaging the carpet between its supporting surface and the horizontally disposed drive roller so that the plurality of radially extending carpet engagement members engages the carpet in a non-slipping fashion. The drive roller is rotated to roll the drive roller over the carpet propelling the frame of the apparatus and thereby the pair of knives mounted on the frame. The knives cut the carpet as the apparatus is propelled forward leaving elongated, glued down strips of carpet on the supporting surface for subsequent stripping.

These and other features and advantages of the invention will be more fully understood from the following detailed description of the invention taken together with the accompanying drawings.

BRIEF DESCRIPTION OF THE DRAWINGS

In the drawings:

FIG. 2 is a frontal view of the apparatus illustrating a pivotable knife bar including a pair of transversely spaceably mounted knives thereon; and FIG. 3 is a bottom view of the apparatus illustrating a drive roller having a plurality of generally radially extending carpet engagement members.

DETAILED DESCRIPTION OF THE INVENTION

Figure 1:
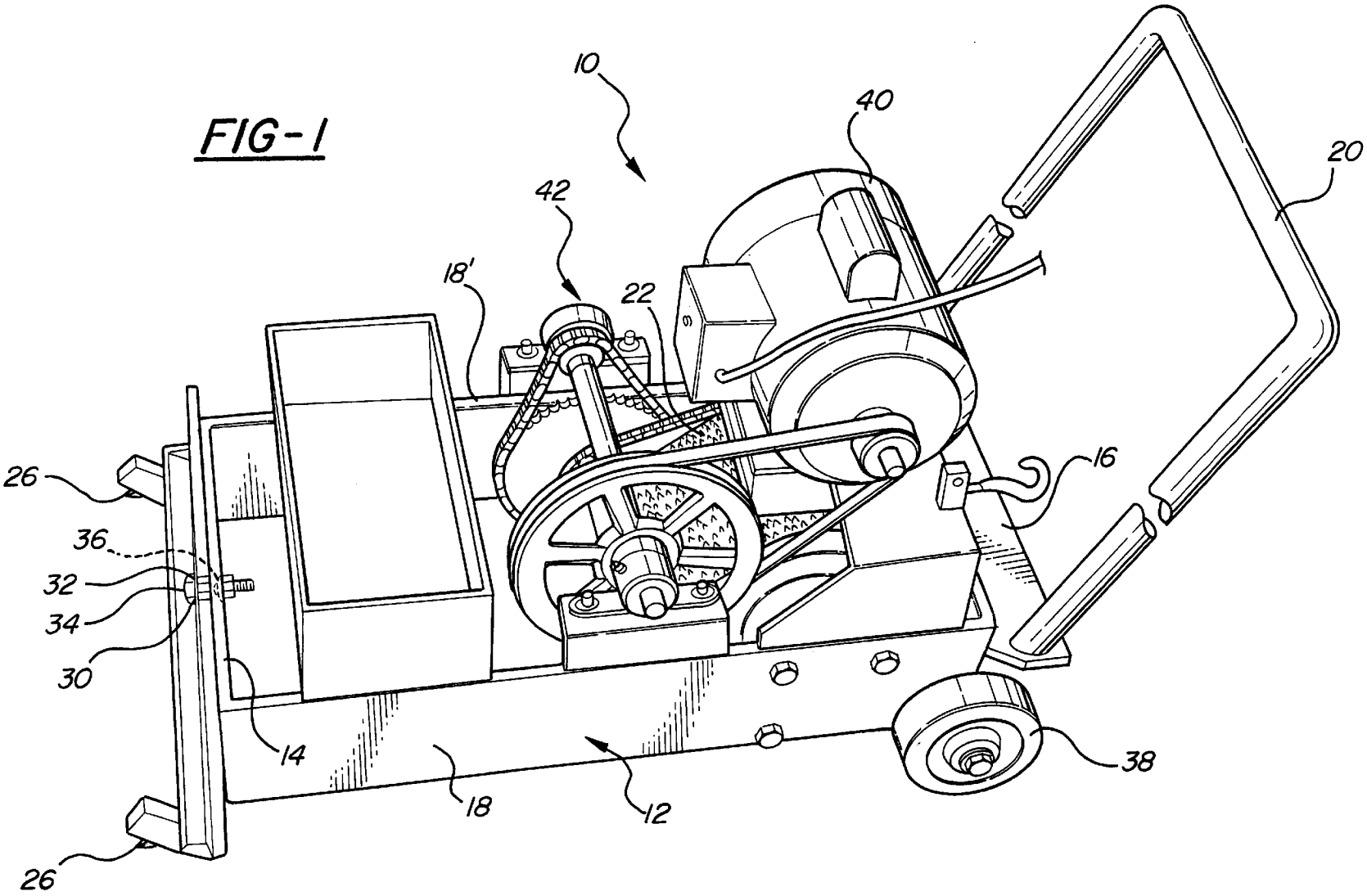
FIG. 1 is a perspective view of a carpet cutting apparatus constructed in accordance with the present invention.

With reference to FIG. 1 of the drawings, a carpet cutting apparatus constructed in accordance with the present invention is generally indicated by reference numeral 10 and is used to cut carpet mounted on a supporting surface into an elongated strip. In commercial applications, carpet is generally adhered to a supporting surface by glue or other adhesive. As is more fully and hereafter described, the carpet cutting apparatus 10 is used to cut the carpet into an elongated strip thereby facilitating subsequent automatic stripping of the carpet by conventional carpet stripping apparatus.

As shown in FIG. 1 of the drawings, the carpet cutting apparatus includes a frame 12 having forward and rearward ends 14,16. Frame 12 also has opposite sides indicated by reference numeral 18 and 18'. The frame 12 includes a handle 20 that extends from the rearward end 16 of the frame 12 and is used for guiding and maneuvering the carpet cutting apparatus 10 during operation.

With further reference to FIG. 1 and with reference to FIG. 3, a drive roller 22 is mounted on the frame 12 between the forward and rearward ends 14,16. Rotation of drive roller 22 over the glued down carpet propels the carpet cutting apparatus 10 in a forward direction. Drive roller 22 includes a plurality of generally radially extending carpet engagement members 24 for non-slippingly engaging the carpet between the drive roller 22 and supporting surface. A pair of knives 26, seen in FIGS. 1 and 2 is mounted on a knife bar 28.

Knife bar 28 transversely spaceably mounts the knives about the frame 12. As illustrated in FIG. 2, the knife bar 28 is mounted for pivotable movement about a longitudinal axis of the cutting apparatus 10 allowing the pair of knives to follow the contour of the supporting surface. Preferably a spacer sleeve 30 extending beyond the thickness of the knife bar 28 is mounted in an aperture 32 of the knife bar. A bolt 34 extends through the sleeve 30 and a vertically extending slot 36 in the forward frame end 14 allowing height adjustment of the knife bar 28 relative to the frame forward end 14 thereby providing for adjustment of the effective length of the carpet engagement members 24.

With reference to FIGS. 1 and 3 of the drawings, the carpet cutting apparatus 10 includes two idler support wheels 38 mounted aft of the rearward frame end 16 and supporting the frame 12 of the carpet cutting apparatus. Alternatively, the idler support wheels 38 may be replaced by an elongated roller 38', illustrated in phantom in FIG. 2.

In the embodiment of the apparatus 10 illustrated in FIG. 1, the handle 20 is mounted to the frame 12 aft of the drive roller 22 whereby upper force on the handle exerts a downward force on the drive roller thereby facilitating further gripping action of the drive roller and sandwiching of the carpet between the drive roller and supporting surface.

A drive motor 40, illustrated as an electric motor, and transmission 42, transmit the rotational force of the drive motor to the drive roller 22. Preferably, the drive motor is mounted on the frame between the drive roller and idler support wheel.

OPERATION OF THE INVENTION

With reference to FIGS. 1–3, carpet adhered to a supporting surface such as concrete is cut into an elongated strip by actuating rotation of the drive roller 22 to cause the apparatus 10 to be propelled forward.

As the drive motor 32 is operated, the drive roller 22 is rotated about its axis. The carpet engagement members 24 engage the backing of the carpet sandwiching the carpet to be cut between the drive roller 22 and the surface supporting the glued down carpet. The rotational and gravitational forces of the drive roller 22 are applied through the limited area of the distal ends of the carpet engagement members to cause the drive roller to engage the carpet without slipping.

As the apparatus 10 is propelled forward, the knives cut the carpet into an elongated strip and the pivotal mounting of the knife bar 28 accommodates any changes in the contour of the carpet supporting surface.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. Apparatus for cutting carpet mounted on a supporting surface into elongated strips, said apparatus comprising:

a frame having forward and rearward ends;

a handle extending from said frame for guiding and maneuvering said apparatus;

a horizontally disposed drive roller, rotatable about a drive roller axis, mounted between said forward and rearward frame ends for propelling said apparatus in a forward direction as said drive roller is rotated in engagement with said carpet mounted on said supporting surface; said drive roller including a plurality of generally radially extending carpet engagement members for non-slippingly engaging said carpet between said drive roller and supporting surface; and a pair of knives spacedly mounted about said forward for removal of the carpet end of said apparatus for cutting said carpet into an elongated strip as the carpet stripping apparatus is propelled forward.

2. Apparatus as in claim 1 including an idler support wheel mounted about said rearward frame end supporting said frame above said carpet.

3. Apparatus as in claim 2 wherein said idler support wheel is an elongated roller.

4. Apparatus as in claim 2 wherein said handle is mounted to said frame aft of said drive roller whereby upward force on said handle exerts a downward force on said drive roller.

5. Apparatus as in claim 2 including a drive motor and transmission driving said drive roller.

6. Apparatus as in claim 5 wherein said drive motor is mounted on said frame between said drive roller and idler support wheel.

7. Apparatus as in claim 1 including a knife bar for adjustably mounting said pair of knives.

8. Apparatus as in claim 7 wherein said knife bar is pivotally mounted on said forward end.

9. Apparatus as in claim 8 wherein said knife bar includes a spacer sleeve extending beyond the thickness of said knife bar mounted in an aperture in said spacer bar about which said knife bar pivots.

10. Apparatus as in claim 9 wherein said frame forward end includes a vertically extending slot for receiving a bolt for adjustably mounting said knife bar relative to said frame forward end.

11. Apparatus as in claim 1 wherein said carpet engagement members are defined by projections extending in the range of 1/16 to ½ inch from the surface of said drive roller.

12. Apparatus as in claim 11 wherein said projections are generally less than ⅜ inch in diameter.

13. Apparatus as in claim 12 wherein said projections include a distal end of an arcuate shape.

14. Apparatus as in claim 12 wherein said projections are integral with said drive roller.

15. A method for cutting carpet adhered to a supporting surface into an elongated strip comprising the steps of:

engaging said carpet between said supporting surface and a horizontally disposed drive roller including a plurality of generally radially extending carpet engagement members;

rotating said drive roller to roll over said carpet while said carpet is mounted to said supporting surface; and cutting said carpet by propelling a pair of knives mounted relative to said drive roller.

16. A method for cutting carpet mounted on a supporting surface using a carpet cutting apparatus including a frame, a horizontally disposed drive roller, including a plurality of generally radially extending carpet engagement members, a pair of knives transversely spacedly mounted about said frame, said method comprising the steps of:

actuating rotation of said drive roller over said carpet while said carpet is mounted on said supporting surface to cause said carpet engagement members to non-slippingly engage said carpet whereby said apparatus is propelled forward while said knives are positioned to cut the carpet upon forward motion to thereby cut said mounted carpet into an elongated strip as said apparatus is moved.

* * * * *